US009222270B2

(12) United States Patent
Hogan

(10) Patent No.: US 9,222,270 B2
(45) Date of Patent: Dec. 29, 2015

(54) ADJUSTABLE CONCRETE FORM

(75) Inventor: Michael E. Hogan, Littleton, CO (US)

(73) Assignee: BLUE COLLAR VENTURES, LLC, Littleton, CO (US)

( * ) Notice: Subject to any disclaimer, the term of this patent is extended or adjusted under 35 U.S.C. 154(b) by 433 days.

(21) Appl. No.: 13/550,428

(22) Filed: Jul. 16, 2012

(65) Prior Publication Data

US 2014/0015154 A1 Jan. 16, 2014

(51) Int. Cl.

| | |
|---|---|
| ***E04G 11/00*** | (2006.01) |
| ***E04G 13/06*** | (2006.01) |
| ***E04G 13/00*** | (2006.01) |
| ***E04G 13/04*** | (2006.01) |

(52) U.S. Cl.
CPC ..... *E04G 13/068* (2013.01); *E04G 13/00* (2013.01); *E04G 13/04* (2013.01)

(58) Field of Classification Search
CPC ..... B28B 7/02; E04G 9/08; E04G 11/06; E04G 11/08; E04G 11/22
USPC ..... 425/182; 249/3, 192, 196
See application file for complete search history.

(56) References Cited

U.S. PATENT DOCUMENTS 2,661,517 A * 12/1953 Findley ..... 249/34
3,841,595 A * 10/1974 Brown ..... 249/14

* cited by examiner

*Primary Examiner* — James Sanders
(74) *Attorney, Agent, or Firm* — Peter B. Scull; Hamilton DeSanctis & Cha LLP

(57) ABSTRACT

An adjustable form having at least two elongated form parts which are capable of being attachable to each other in an adjustable manner relative to each other. A kit for an adjustable form having a package for containing at least two elongated form parts which are either or both adapted for or capable of being attachable to each other in an adjustable manner. A method for use of a form unit including assembling a form unit; disposing the form unit in the creation of an overall structure form for the creation of the ultimate structure; creating the ultimate structure.

11 Claims, 9 Drawing Sheets

10
11
12
13a
13b
14
15a
15b
15c
16a
16b
16c
21
22
23
24
25
26a
26b
26c

ADJUSTABLE CONCRETE FORM

BACKGROUND

The present development or developments relate generally to a form used in the construction industry for the pouring and forming of concrete, but more particularly to re-usable, adjustable forms.

In the laying of various types of tile or like building materials for construction or re-modeling it is often desirable for the operator to have the use of a set of forms which he can use to create a desired concrete formation of a desired height, width and length. A typical formation may include a curb for water retention, as for example in a construction of a shower. Concrete formation construction projects vary in size as a consequence of the particular project. Forms are generally made using dimensional lumber purchased specifically to accommodate a specific formation dimension. The lumber then is further cut to meet the desired finish concrete formation size, height, width and length. After the concrete for the formation is poured and time is allowed for the concrete to set, the forms are removed. The use of wood forms allows for one to cut them to fit each formation, but in such usages, the forms are virtually useless in future applications. All projects are necessarily of varying dimension and the stockpiling of various "used forms" is not reasonable. The dissipation of the water from the cement mix into the wood form also has a negative effect on the wood. Such water influx causes the wood to warp and twist. Once the securing devices are released the wood assumes a varied shape due to water absorption.

Thus it can be found desirable to achieve a form which can be adjusted/modified to appropriate alternative dimensions and then re-used over and over; as well as to alternatively or additionally, optionally achieve a form which may be resistant to water and will have no resulting ill effects due to exposure to water.

BRIEF SUMMARY

Disclosed here is at least an adjustable form having two elongated form parts which are capable of being attachable to each other in an adjustable manner.

These and still further aspects as shall hereinafter appear are readily fulfilled by the present developments in one or more remarkable and/or unexpected manners as will be readily discerned from the following detailed description of exemplary implementations thereof especially when read in conjunction with the accompanying drawings in which like parts bear like numerals throughout the several views.

DETAILED DESCRIPTION

Following here read together with and in view of the attached drawings are descriptions of one or more forms according to the developments hereof.

Figures 1, 2, 3, 4:
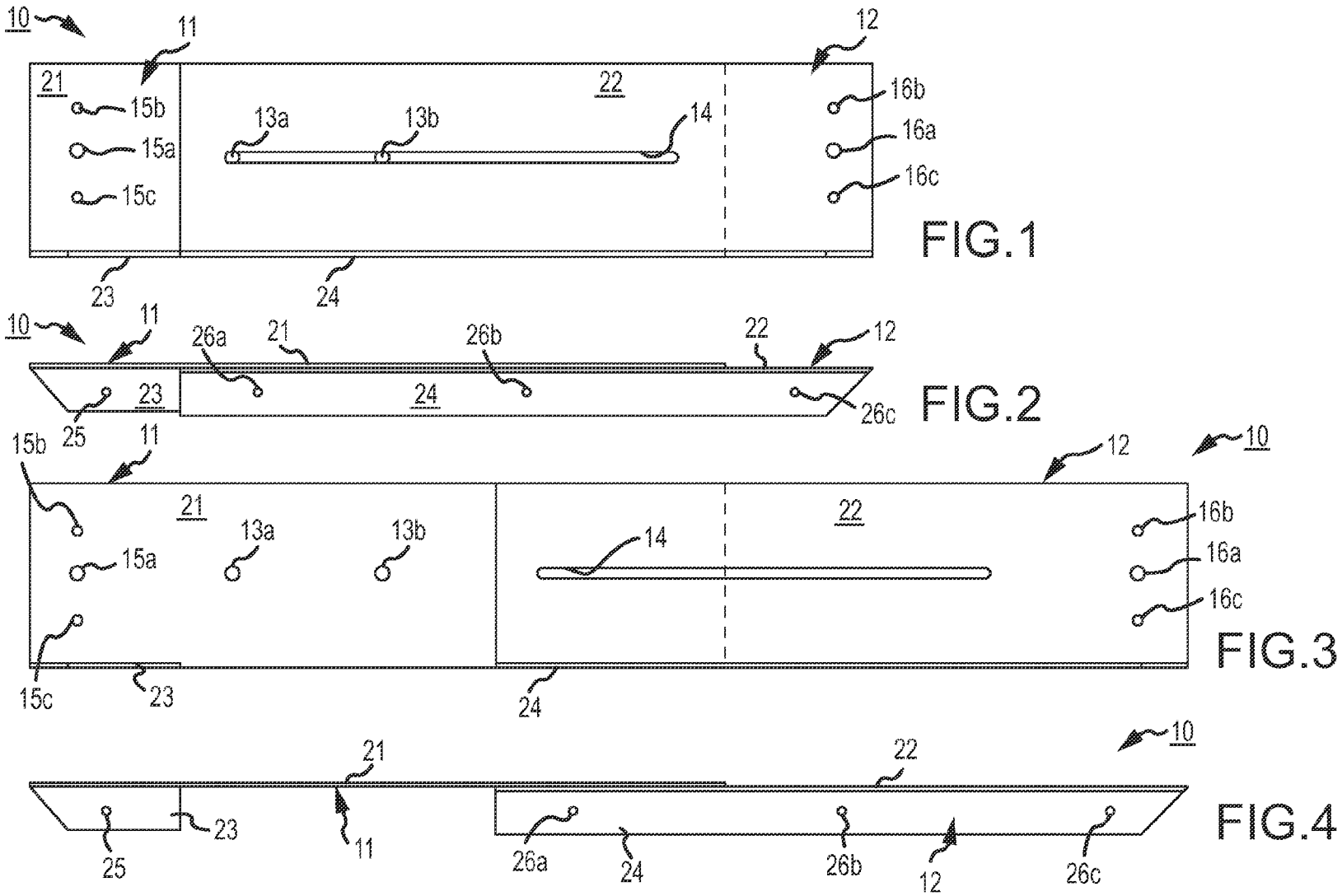
FIG. 1 is an elevation view of an adjustable form hereof shown in retracted disposition.
FIG. 2 is a plan view of an adjustable form hereof shown in retracted disposition.
FIG. 3 is an elevation view of an adjustable form hereof shown in extended disposition.
FIG. 4 is a plan view of an adjustable form hereof shown in extended disposition.

In a first set of examples, FIGS. 1-4 provide alternative views of an assembled, or partially assembled, adjustable form unit 10 hereof. The combination form unit 10 may generally have two elongated form parts, 11 and 12, as shown in FIGS. 1-4, which may be adapted to or capable of being slideably moveable relative to and attachable to each other to be disposed in a substantial retracted or closed disposition as shown in FIGS. 1 and 2, or in a relatively extended or open disposition as shown for example in FIGS. 3 and 4. FIGS. 1 and 3 also show various bolt holes, here e.g., holes 13 (specific examples, 13*a* and 13*b* in part 11 in FIGS. 1 and 4), and a slot 14 in form part 12, that can be used to secure the unit together once the desired length is established as one or more connective devices such as bolts (not shown in FIGS. 1-4) will secure the two parts together anywhere along the line of the slot, and/or if multiple bolt holes are provided, the bolts might be able to move to different bolt holes as the form is adjusted out or in. Note, any alternative combination of either or both slots and/or bolt holes may be used (as for example where each of parts 11 and 12 have bolt holes, or each have slots, or alternative slots and/or holes may be used). Further alternative/optional bolt or screw holes 15 and 16 (specific examples in FIGS. 1 and 3 of holes 15*a*, 15*b* and 15*c* in part 11 and 16*a*, 16*b* and 16*c* in part 12; noting that it may be preferred to have different sized and positioned holes for different purposes, as for example and as further described below, in connecting multiple forms to use bolts and bolt holes, which in FIGS. 1 and 3 may be indicated by the larger center holes 15*a* and 16*a*, as opposed to what may be preferred as screw/wall connection holes 15*b*, 15*c* and 16*b*, 16*c*) are also shown in FIGS. 1 and 3 as these might be used for a variety of purposes, e.g., to add or connect to additional forms (described below) and/or to anchor the form to a substrate or support structure such as a wall.

As shown in FIGS. 1-4, each of the parts 11 and 12 has a respective elevational wall portion 21, 22 for forming the concrete by being disposed adjacent thereto; as well as respective base or foot portions 23, 24 which in many cases can be used to hold the wall portions in upright or substantial upright operational position. The base of one form, here, base 23 of part 11, may be partial or reduced in scope so as to allow for a relative marrying of the respective bases into a continuous base in full closed form, thus creating a relative continuous base in this disposition. In the open alternative, a relative space will be opened between these foot portions 23 and 24 as shown in FIGS. 3 and 4. Some optional bolt or screw holes 25 and 26 (specific examples 26*a*, 26*b* and 26*c*) are also shown in FIGS. 2 and 4 for, inter alia, anchoring these forms to a floor or other support structure.

One or more form units 10 in assembled, partially-assembled, or disassembled form; particularly, two or more of the above-described elongated parts 11 and 12, or the like, may be provided in or as a partially assembled, or pre-disassembled kit of parts capable of being assembled as described and/or as shown herein. In one such implementation, a package (not separately shown, but readily appreciable), as for example, a box or a bag, may be provided to accommodate and hold the various parts included in or as part of the kit. In some such, the first and second elongated parts 11 and 12 may be included in and define the kit. In some further alternatives, one, two or more connective devices, bolts and/or screws or other attachment devices may be included within the package and be part of the kit to be used in assembling the elongated parts relative to each other to hold the parts 11 and 12 together and/or to anchor the parts 11 and/or 12 to a support structure, a floor and/or a wall. Other alternative implementations may further include, one, two or more angle brackets for anchoring purposes and/or for connecting elongated form parts together, as will be described further below. Instructions for use and/or assembly may be included.

Thus disclosed here are one or more alternative adjustable concrete forms 10, particularly which can be retracted or extended to fit and/or create a desired formation. Such a form in these pictured implementations has anchor points on two planes for securing to floors and/or walls during the cement curing process. A complete form might include two sub-parts 11 and 12 as one unit 10, or in some implementations, may be considered to include two of these sets, such as cooperative sets 10*a* and 10*b* as shown in FIG. 5 thus, including four sub-part forms 11*a*, 11*b*, 12*a* and 12*b*; two each are alike and adapted to be bolted together to the other respective operative forms to create a two-part "set".

Figure 5:
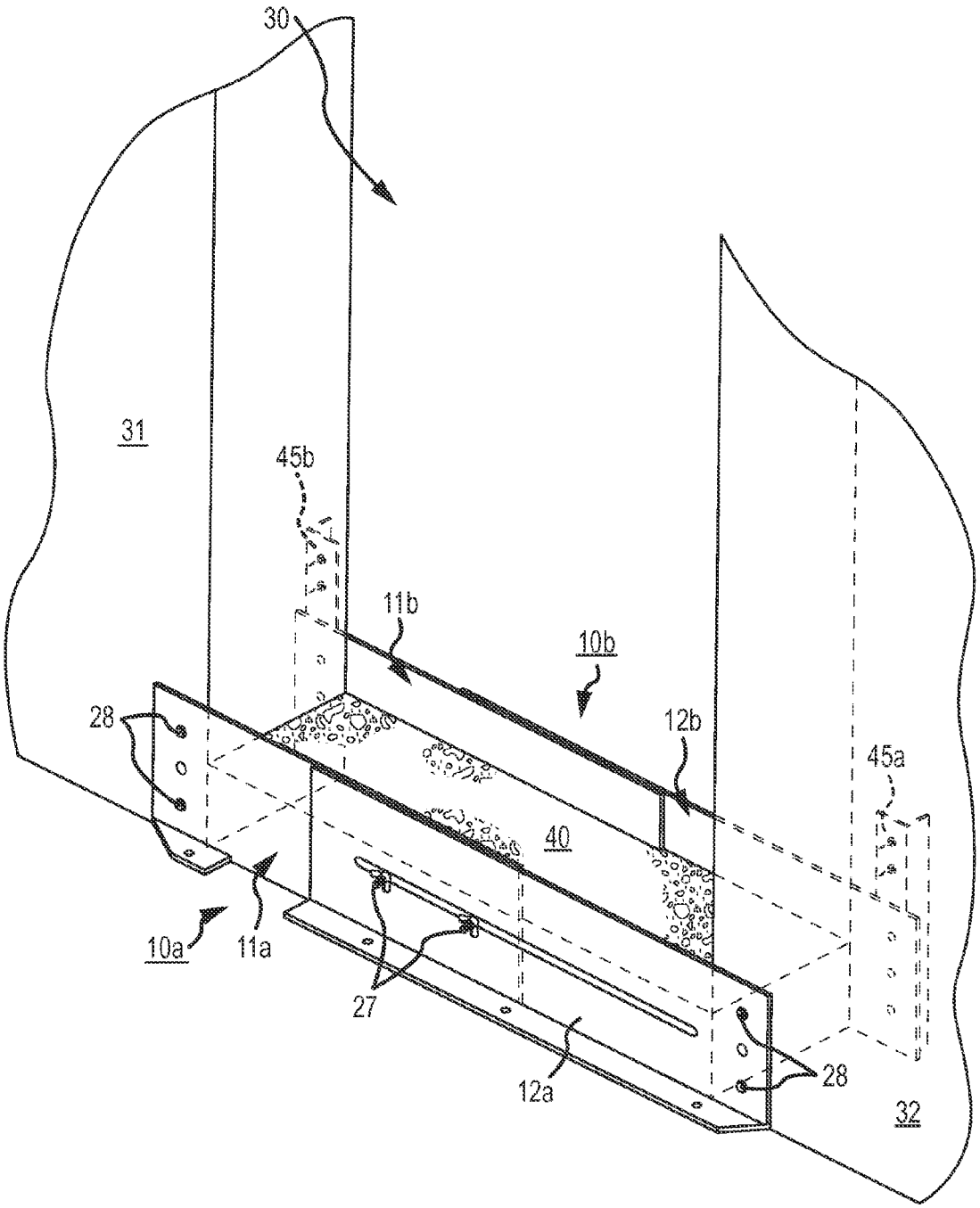
FIG. 5 is an isometric view of two adjustable forms hereof shown in an alternative partially extended operational disposition.

More specifically what is shown in FIG. 5, for an operational example, is a front adjustable form 10*a* of parts 11*a* and 12*a* in partially extended disposition connected to and between two walls 31, 32 in a doorway generally designated as 30. Connection devices, screws or bolts 27, 28 are shown as these might effectuate the connection of the elongated parts to each other, see elongated part connection bolts 27 (with wing-nuts here) and/or to external supports such as the walls 31, 32, here, through use of wood screws 28, e.g. Also shown is a back form 10*b* with parts 11*b* and 12*b* thereof shown also connected to walls 31 and 32 (bolts or other connections not directly shown). Shown formed between forms 10*a* and 10*b* is a concrete formation 40, here a curb or like structure. A feature hereof may include the readily cognizable ability to form such a structure 40 regardless the distance between walls. Indeed, in some implementations, two or more front forms could be hooked together (as by connecting the right side bolt holes 16 of one form; see FIG. 3, with the left side bolt holes 15 of another form; left and right only for descriptive purposes here relative to FIG. 3; not intending or requiring any limitation on orientation, operationally or otherwise; noting again, it may be preferred in connecting multiple forms to use bolts and bolt holes, which in FIGS. 1 and 3 may be indicated by the larger center holes 15*a* and 16*a*, as opposed to what may be preferred as screw/wall connection holes 15*b*, 15*c* and 16*b*, 16*c*). Also shown in phantom in FIG. 5 are two other alternative/optional angle members 45 (here, 45*a* and 45*b*) which can be used for alternative connection or anchoring; as will be described in further detail relative to FIGS. 6, 7, and 8, below.

Figure 6:
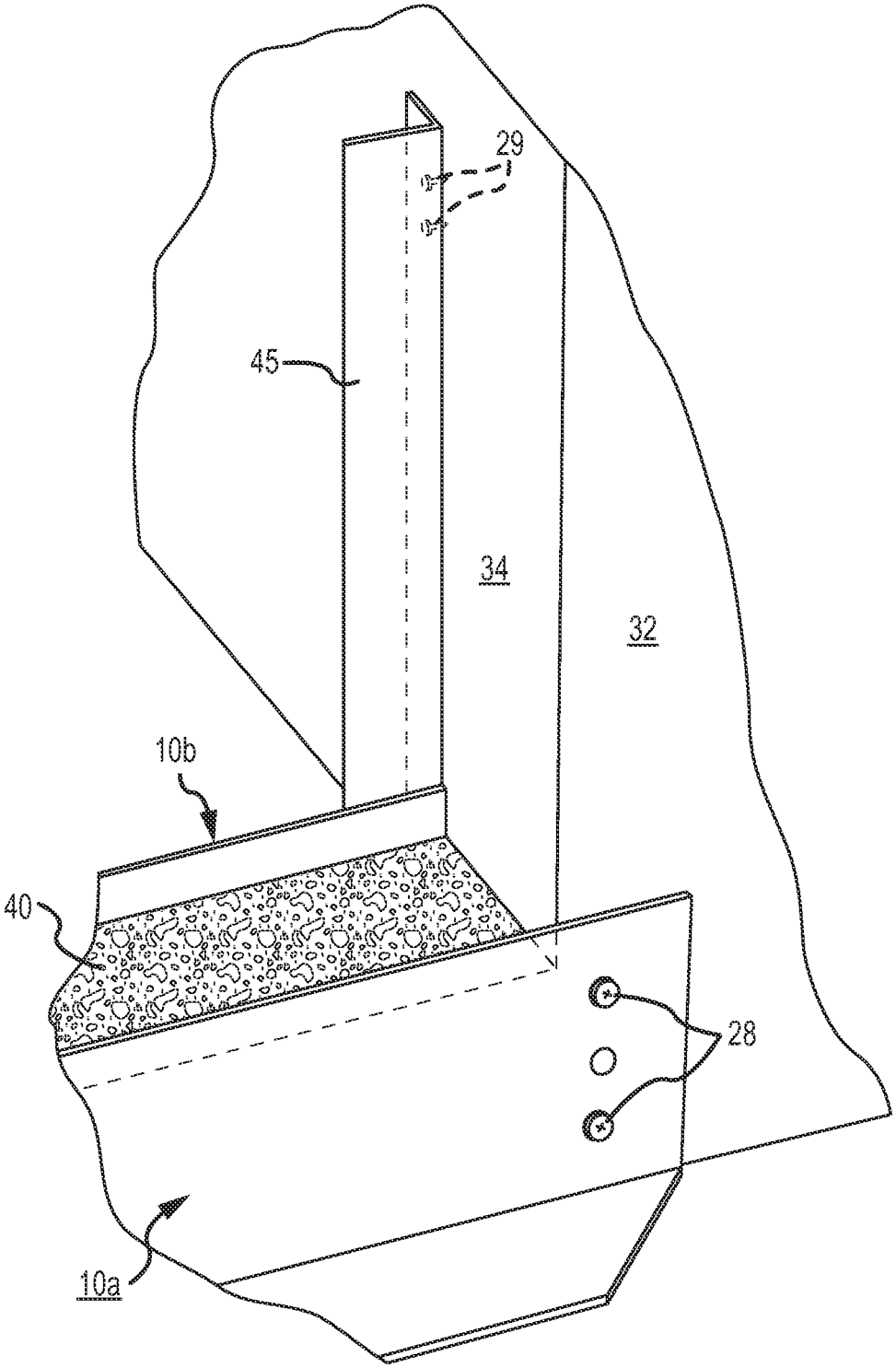
FIG. 6 is an isometric view of portions of two adjustable forms hereof shown in an alternative operational disposition.
Figure 7:
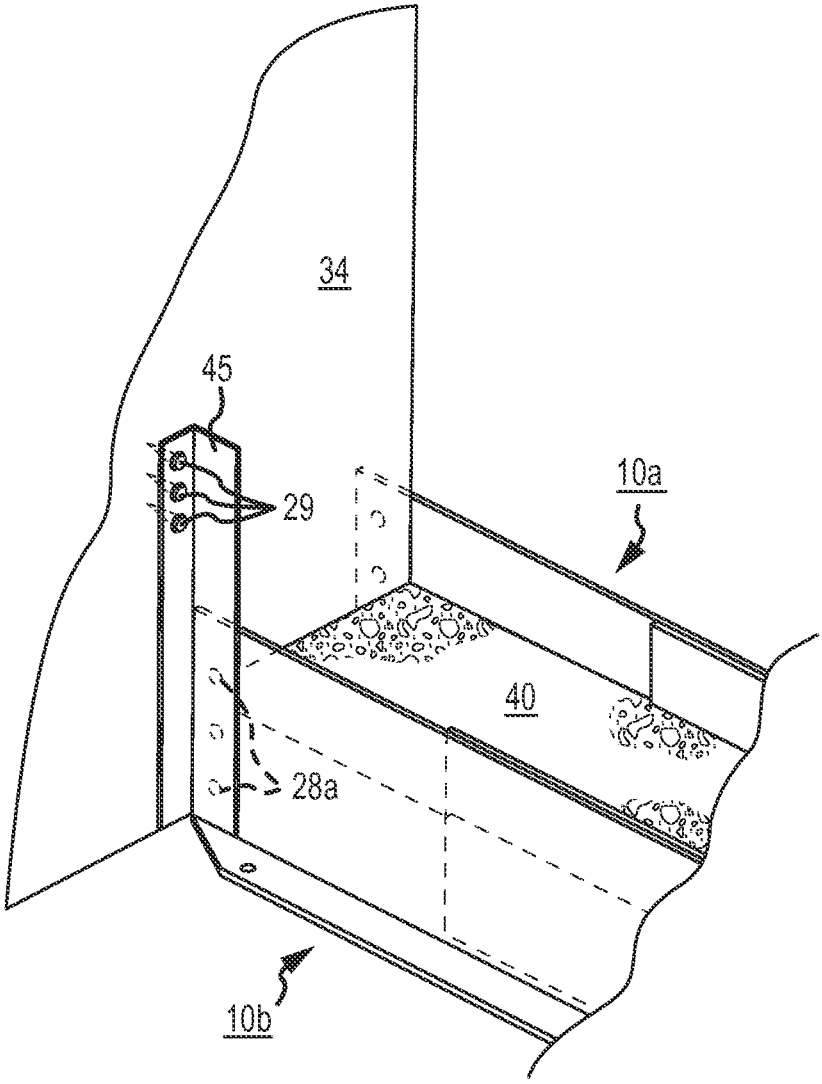
FIG. 7 is an isometric view of two adjustable forms hereof shown in an alternative operational disposition.
Figure 8:
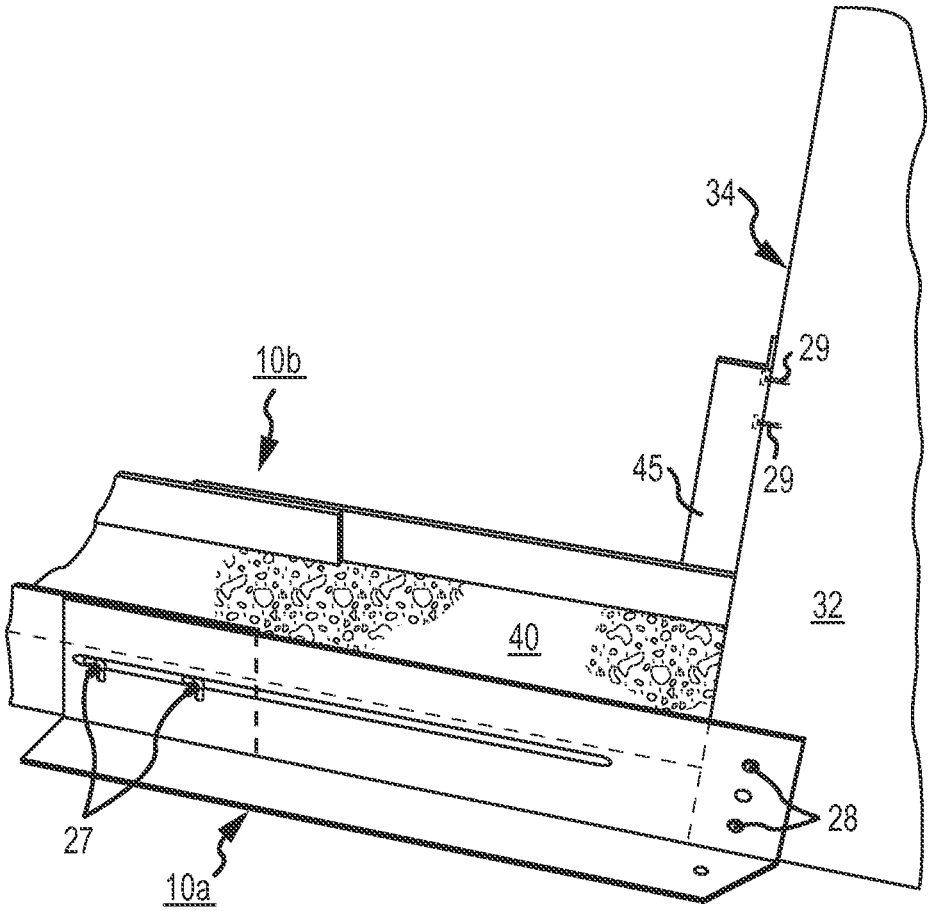
FIG. 8 is another isometric view of two adjustable forms hereof shown in an alternative operational disposition.

FIGS. 6, 7 and 8 provide alternative views of an implementation not unlike that of FIG. 5 particularly providing the optional ability of the use of, e.g., a 90 degree angle bracket 45 or the like; wherein an angular bracket or flange 45 is shown in a little more detail as it might be used to connect or anchor the form 10*b* to or adjacent the substantially perpendicular facing wall 34 (other relative angles, other than mere perpendicular or thereabout may also be used). This is an alternative optional connection or anchoring method, or mechanism when the wall for connection is facing as opposed to the substantially co-planar type of connection shown for more frontal elongated part 10*a* to wall 32 (also as shown in FIGS. 6 and 8). As another example, a reverse view of this is shown in FIG. 7. More specifically, flange 45 is shown adjacent and/or abutting form 10*b* and at a substantial right angle thereto, and connected by one, two or more screws 29 to wall 34. Note, it may be preferred to have no actual connection devices (here designated in FIG. 7 by the absence of elements 28*a*) actually connecting flange 45 with form 10*b* because any device run through the holes at 28*a* (shown in dashed lines as these might be optional or might merely reflect the holes in the structure 10*b* as hidden by flange 45) would unfortunately be disposed in the concrete structure as it is formed and set, at least partially, and thus, likely be dis-favored—though such a connection could nevertheless be achieved in some implementations. Even so, the abutting relationship shown here can/should provide sufficient support to maintain form 10*b* in desired operation position as indicated in FIGS. 6-8. Thus, flange 45 shows an alternative connection or anchoring for a form 10 in an operative disposition, generally. FIG. 8 shows yet one other alternative view of this, wherein two of the bolts 29 are shown in phantom as they might be disposed within the wall 34.

Figure 9:
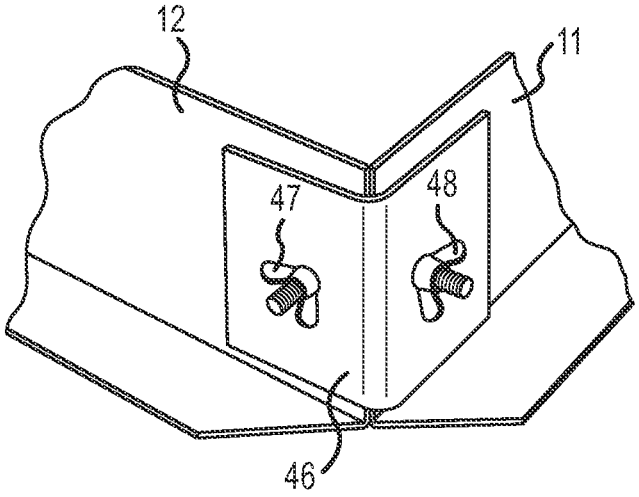
FIG. 9 is yet another isometric view of two adjustable forms hereof shown in an alternative connected operational disposition.

Next, more specifically shown in FIG. 9 is yet another alternative connection of two parts 11 and 12. Here shown is an angle bracket or flange 46 shown connecting respective members 11 and 12 in an approximate right angle (plus or minus 90 degree angle, in this example, other angles possible within the scope hereof, see below) for one of unlimited options of likely positioning of bolt or screw holes for the addition of another curb form. Thumbscrews or wing nut bolts 47, 48 are shown here making this connection, as they might be used for any of the other connections of members or parts herein; however, other connection mechanisms or devices could alternatively be used here, as with other parts hereof. Though not intended to be limited or requiring the following, the holes shown for wall anchoring are shown in FIGS. 1-4 smaller for appropriate wall screws, e.g., holes 15*b*, 15*c*, 16*b*, and 16*c* in FIGS. 1 and 3, and bolts for larger holes 15*a* and 16*a* of FIGS. 1 and 3 for this FIG. 9 connection.

Figure 10:
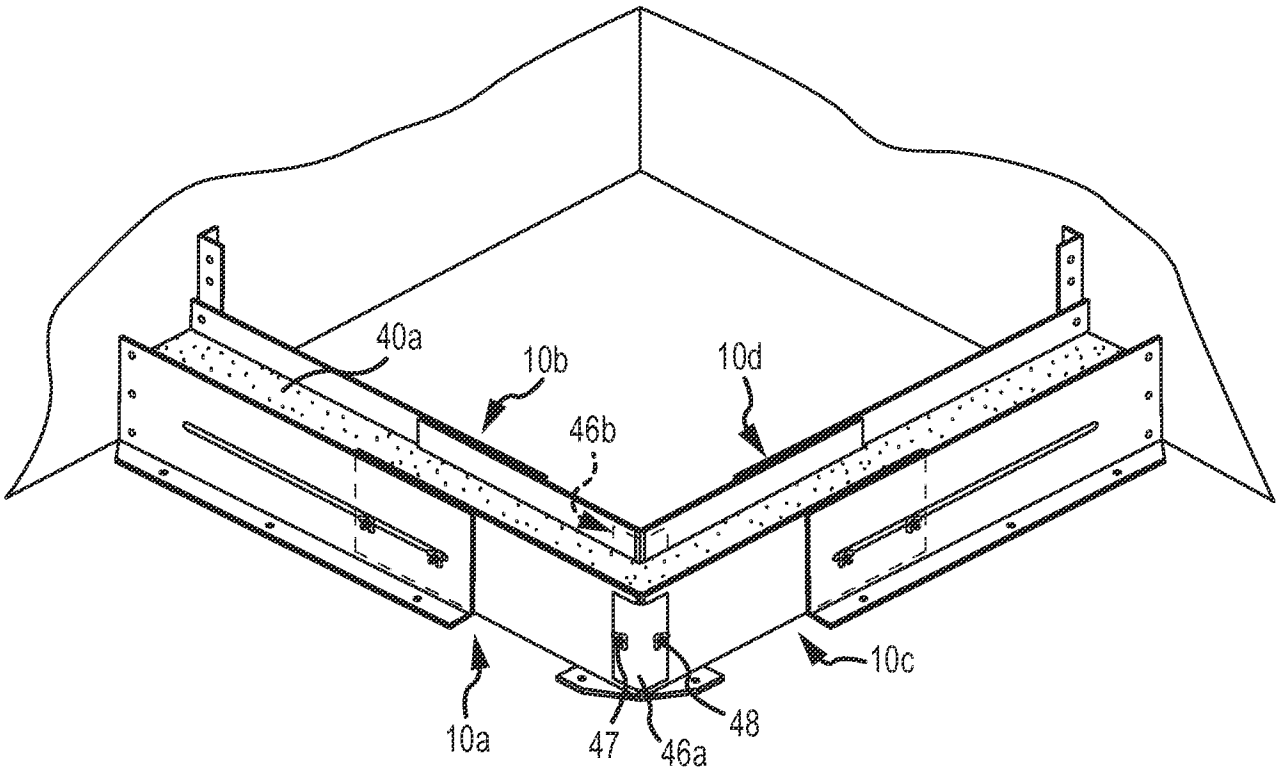
FIG. 10 is still another isometric view of adjustable forms hereof shown in an alternative connected operational disposition.

FIG. 10 provides an enlarged view of an implementation not unlike that of FIG. 9 particularly using a ninety (90) degree angle bracket 46*a* like bracket 46 of FIG. 9 (bolted connections 47 and 48 are also shown). Bracket 46*a* is shown in FIG. 10 connecting two form units 10*a* and 10*c* to provide the front side form for a ninety degree form creation for the making of a ninety degree structure 40*a*. A backside ninety degree form is also shown in FIG. 10 created by the connection of two forms 10*b* and 10*d* by a bracket 46*b* (shown in partial and in phantom).

Figure 11:
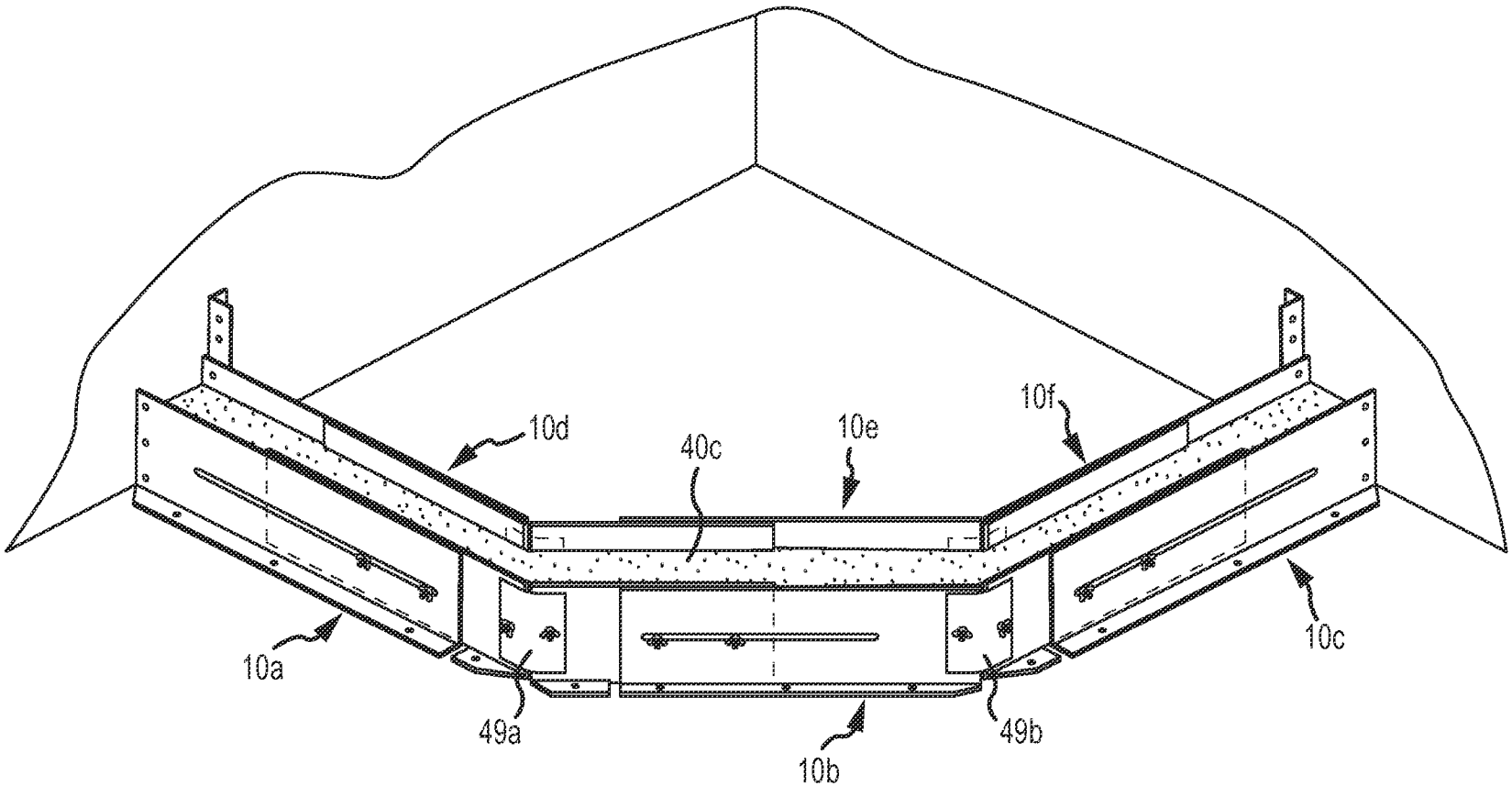
FIG. 11 is still yet one further isometric view of adjustable forms hereof shown in an alternative connected operational disposition; and, FIG. 12 is an optional methodology hereof.

FIG. 11 provides a further alternative implementation not unlike that of FIG. 10 here particularly providing the optional ability of the use of, e.g., one or more substantially 45 degree angle bracket(s) or the like to adapt to change of structure/curb angle if so desired; wherein an angular bracket or flange 49, here shown with two discrete flanges 49*a*, 49*b* connecting three discrete forms 10*a*, 10*b* and 10*c* to create the front form for structure 40*c* of FIG. 11. Backside units 10*d*, 10*e* and 10*f* are also shown in FIG. 11; which backside form units might also utilize similar substantial forty five (45) degree or like angle brackets for their connections.

Figure 12:
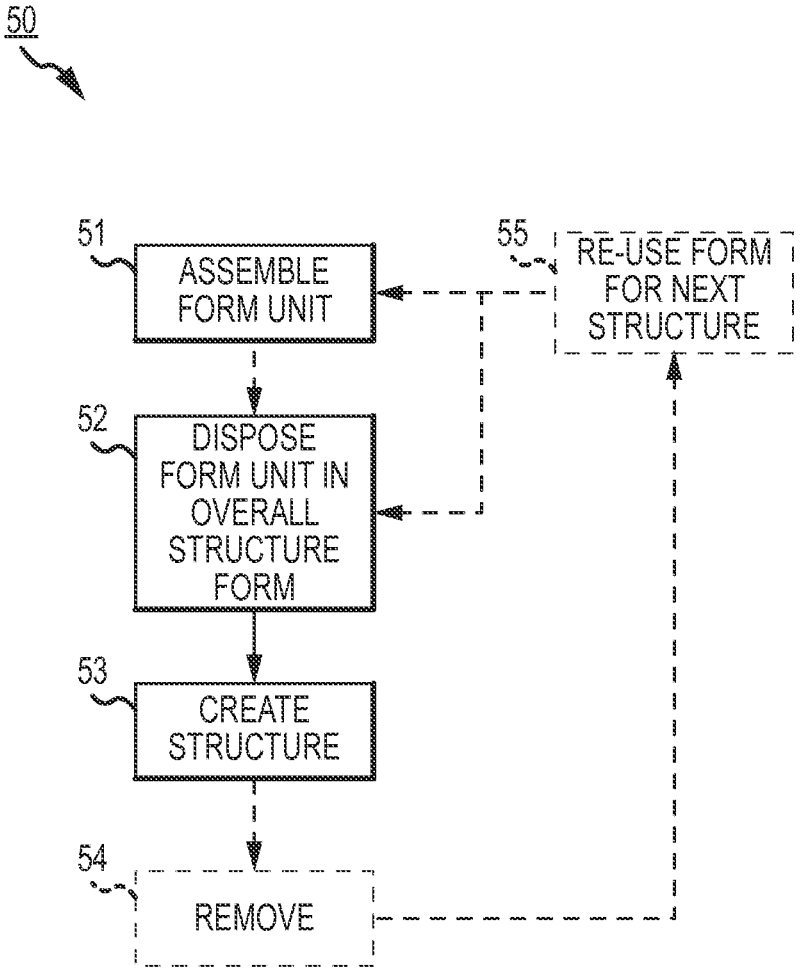

FIG. 12 provides a general method 50 which could be used herewith. An optional first step or operation 51 might be to assemble a form unit, e.g., a unit 10 (any of units 10*a*, 10*b*, 10*c*, 10*d*, 10*e*, 10*f*, etc.), with respective second and third steps or operations 52 and 53 of disposing the form unit 10 in the creation of an overall structure 40 form for and then the creation/creating of the ultimate structure 40. The first operation 51 might be optional if the unit 10 might have come pre-assembled; optionality here indicated by the dashed arrow line from box 51 to box 52. The assembly operation may include the operation of sizing, sliding and/or connecting and/or bolting the elongated parts 11 and 12 together to form unit 10 of a desired size. Optional removal and re-use steps or operations 54 and 55 are also shown as these might come after the creation of a structure 40. Re-use may be or may include and/or come before either or both or either of the assembly or disposition operations 51 and/or 52; i.e., re-use may in some instances require some re-assembly, as for example, re-sizing, and/or connection to other units 10; or in some other instances no re-assembly might be necessary whatsoever, and the unit put right into a subsequent re-disposition for creation of a new structure, i.e., moving directly to operation 52 without moving through operation 51.

The present developments relate generally to forms used in the construction industry for the pouring of concrete, but in more particular implementations can be related to the type of work involving the pouring of concrete shower pans for shower installations and the related curbs made to retain water as the shower is used. In the laying of various types of tile or like building materials for construction or re-modeling is desirable for the operator to have the use of a set of forms which he can use to create the desired curb width and length. Tile projects all vary in size of the shower enclosure. An adjustable curb "unit" or form can for such shower type implementation be about 5" high and have a base width of approximately 1.5". A unit hereof for such uses can be provided for and adapted for adjustment from 36" out to a full extension to 60". An alternative might be an approximate 24" aluminum curb unit, particularly as it may be adjusted from about 24" out to about 38". A further alternative might be an approximate 18" unit adjustable between about 18" and about 30". All considerations listed prior for a 36" adjustable curb form unit would then generally be also applicable for the 24" unit and the 18" unit. The base of one form would be partially removed to marry into a full length form, thus creating a continuous base. The bolts will be able to move to different bolt holes as the form is adjusted out or in. The use of three types of "brackets" for the use of anchoring the curb form units, as described above, may include a use of 4" bracket or the like in this curb form implementation for the right angle connection, and one or more 12" brackets or the like, size/shape that can be interchangeable as the circumstances dictate or as the operator chooses their use.

Thus herein provided can be a form which can be adjusted/modified to any/every shower pan dimension or opening and then re-used over and over. A form which is resistant to water and will have no resulting ill effects due to exposure to water may also be a result. In many implementations, a light weight metal such as aluminum may be used for the curb form.

From the foregoing, it is readily apparent that new and useful implementations of the present developments have been herein described and illustrated which fulfill numerous desiderata in remarkably unexpected fashions. It is, of course, understood that such modifications, alterations and adaptations as may readily occur to the artisan confronted with this disclosure are intended within the spirit of this disclosure which is limited only by the scope of the claims appended hereto.

What is claimed is:

1. An adjustable form comprising:

at least two elongated form parts which are capable of being attachable lengthwise relative to each other in multiple infinitesimal length adjustable dispositions relative to each other and/or at multiple angle dispositions; with one or multiple anchor points;

wherein the at least two elongated form parts are configured to or capable of being slideably moveable relative to and attachable to each other to provide the infinitesimally adjustable lengthwise dispositions;

a first one of the at least one of the at least two elongated form parts having a single elongated slot disposed therein defined lengthwise relative thereto and another one of the at least two elongated form parts having one or more bolt holes disposed therein to provide for connection of the at least two elongated form parts together; and, one or more of: a connection device, bolt or screw for holding the at least two elongated form parts in operative disposition relative to each other;

wherein the single elongated slot disposed in the first elongated form part and the plurality of bolt holes disposed in the second of the elongated form parts and the one or more of connection devices, bolts and screws coact to provide for connection of the parts together in one or both of infinitely or infinitesimally adjustable lengths relative to each other along and anywhere in the entire length of the single elongated slot; the one or more of the connection devices, bolts and screws are configured to be disposed simultaneously inserted in and through both the single elongated slot and the one or more bolt holes to effectuate the connection of the at least two elongated form parts to each other; and, the two or more elongated parts being adapted to be connected in an alternative angular disposition relative to each other, and in anchored position relative to a substrate, support structure, floor or wall.

2. An adjustable form according to claim 1 further comprising one or more bolt or screw holes to one or both of connect to additional forms and anchor the form to a substrate, or support structure, or wall or floor.

3. An adjustable form according to claim 1, the two elongated form parts each having a respective elevational wall portion for forming the concrete by being disposed adjacent thereto in operational disposition; as well as each of the respective elongated form parts having respective base or foot portions which can be used to hold the respective wall portions in operational disposition.

4. An adjustable form according to claim 3, the base of one form having a partial or reduced area so as to allow for a relative marrying of the respective bases into a continuous base in a full closed form, thus creating a relative continuous base in this disposition, and, a relative space opened between these foot portions in an open disposition.

5. An adjustable form according to claim 1, wherein the one or more of a connection device, bolt or screw is for one or both of holding the elongated parts in operative disposition relative to each other and in anchored position relative to a substrate, support structure, floor or wall.

6. An adjustable form according to claim 1, further comprising one or more angle brackets for one or both of holding the elongated parts in operative disposition, connecting two or more elongated parts in angular disposition relative to each other, and in anchored position relative to a substrate, support structure, floor or wall.

7. A kit for an adjustable form comprising:

a package for containing;

at least two elongated form parts which are either or both adapted for or capable of being attachable lengthwise relative to each other in multiple infinitesimal length adjustable dispositions relative to each other and/or at multiple angle dispositions; with one or multiple anchor points;

wherein the at least two elongated form parts are configured to or capable of being slideably moveable relative to and attachable to each other to provide the infinitesimally adjustable lengthwise dispositions;

a first one of the at least one of the at least two elongated form parts having a single elongated slot disposed therein defined lengthwise relative thereto and another one of the at least two elongated form parts having one or more bolt holes disposed therein to provide for connection of the at least two elongated form parts together; and, one or more of: a connection device, bolt or screw for holding the at least two elongated form parts in operative disposition relative to each other;

wherein the single elongated slot disposed in the first elongated form part and the plurality of bolt holes disposed in the second of the elongated form parts and the one or more of connection devices, bolts and screws coact to provide for connection of the parts together in one or both of infinitely or infinitesimally adjustable lengths relative to each other along and anywhere in the entire length of the single elongated slot; the one or more of the connection devices, bolts and screws are configured to be disposed simultaneously inserted in and through both the single elongated slot and the one or more bolt holes to effectuate the connection of the at least two elongated form parts to each other; and, the two or more elongated parts being adapted to be connected in an alternative angular disposition relative to each other, and in anchored position relative to a substrate, support structure, floor or wall.

8. A kit for an adjustable form according to claim 7, comprising three or more elongated form parts which are either or both adapted for or capable of being attachable to each other in an adjustable manner.

9. A kit for an adjustable form according to claim 7, the base of one form having a partial or reduced area so as to allow for a relative marrying of the respective bases into a continuous base in a full closed form, thus creating a relative continuous base in this disposition, and, a relative space opened between these foot portions in an open disposition.

10. A kit for an adjustable form according to claim 7, wherein the one or more of a connection device, bolt and screw is for one or both of holding the elongated parts in operative disposition relative to each other connected via respective slot and holes in the respective elongated parts and in anchored position relative to a substrate, support structure, floor or wall.

11. A kit for an adjustable form according to claim 7, further comprising one or more angle brackets for one or both of holding the elongated parts in operative disposition, connecting two or more elongated parts in angular disposition relative to each other, and in anchored position relative to a substrate, support structure, floor or wall.

* * * * *